US006336972B1

(12) United States Patent
Kimura et al.

(10) Patent No.: US 6,336,972 B1
(45) Date of Patent: Jan. 8, 2002

(54) OIL COATING APPARATUS

(75) Inventors: Kohichi Kimura; Tatsuo Takagi, both of Shizuoka; Yoshiyuki Motoyoshi, Tokyo; Shigeru Nakama, Shizuoka; Isami Abe, Shizuoka, all of (JP)

(73) Assignees: Nichias Corporation, Tokyo; Zenith Corporation, Tochigi, both of (JP)

( * ) Notice: Subject to any disclaimer, the term of this patent is extended or adjusted under 35 U.S.C. 154(b) by 0 days.

(21) Appl. No.: 09/346,936

(22) Filed: Jul. 2, 1999

(30) Foreign Application Priority Data

| | | |
|---|---|---|
| Jul. 3, 1998 | (JP) | 10-202868 |
| Feb. 24, 1999 | (JP) | 11-045900 |
| Mar. 2, 1999 | (JP) | 11-097942 |

(51) Int. Cl.[7] ..... B05C 1/00
(52) U.S. Cl. ..... 118/270; 118/264
(58) Field of Search ..... 156/329; 118/264, 118/265, 266, 267, 268, 269, 270; 492/52

(56) References Cited

U.S. PATENT DOCUMENTS 5,779,795 A * 7/1998 Bucher et al.

FOREIGN PATENT DOCUMENTS

| | | |
|---|---|---|
| JP | 6-73051 | 9/1994 |
| JP | 9-185282 | 7/1997 |

* cited by examiner

*Primary Examiner*—Brenda A. Lamb
(74) *Attorney, Agent, or Firm*—Nixon & Vanderhye

(57) ABSTRACT

An oil coating roller comprising a porous round-rod-like molded product, a heat-resistant fiber felt layer provided on an outer circumference of the porous round-rod-like molded product, and a porous film applied onto an outer circumference of the felt layer. The porous round-rod-like molded product contains heat-resistant fibers bound to each other by a binder, and has fine communicating voids free from the binder among the fibers and evenly distributed pores having a pore size in a range of from 0.05 to 2 mm and a total void percentage in a range of from 30 to 90%. The porous round-rod-like molded product is impregnated with silicone oil. The heat-resistant fiber felt layer has a thickness in a range of from 0.5 to 5 mm. The porous film has a thickness in a range of from 15 to 130 $\mu$m, a mean pore size in a range of from 0.1 to 3.0 $\mu$m, a porosity in a range of from 60 to 90% and an air permeability in a range of from 3 to 1500 sec per 100 cc.

8 Claims, 2 Drawing Sheets

OIL COATING APPARATUS

FIELD OF THE INVENTION

The present invention relates to an oil coating apparatus which is one of constituent parts of a fixing apparatus in an electrostatic copying machine, an electrophotographic printer, or the like. Particularly, it relates to an oil coating roller which is one of constituent parts of a fixing apparatus in an electrostatic copying machine, an electrophotographic printer, or the like (especially, for the purpose of color copying or multicolor printing).

BACKGROUND OF THE INVENTION

In a fixing apparatus in an electrostatic copying machine or in an electrophotographic printer, an oil coating roller rotating while touching a fixing roll directly or indirectly is generally provided to apply a very small quantity of silicone oil onto the fixing roll continuously to thereby prevent recording paper from being stained with toner remaining on the fixing roll.

Various types of oil coating rollers have been already provided. There are oil coating rollers of the type in which a cylindrical molded product of a metal pipe or heat-resistant fibers having a large number of pores in its wall is used as an oil holding member for storing oil to be applied and in which an oil coating member layer of heat-resistant felt is provided on a surface of the cylindrical molded product. Of this type oil coating rollers, an oil coating roller using, as the oil holding member, a porous cylindrical molded product containing heat-resistant fibers bound to one another by a binder and having fine communicating voids free from the binder among the fibers and evenly distributed pores with a pore size of from 0.05 to 2 mm and a total void percentage of from 30 to 90% (JP-A-9-108601) has a merit that oil is applied stably in a long term because not only the oil holding member can hold a large quantity of silicone oil but also the oil holding member can discharge silicone oil stably in a long term even under a high-loading condition.

In the case where the oil coating roller is used in a fixing apparatus for a color copying machine or a color printer, the aforementioned merit is unchanged but there is a tendency that the quantity of coating of oil increases excessively for a while (up to hundreds of sheets or a thousand sheets as the number of sheets of recording paper fed to the fixing apparatus) after the start of use because silicone oil having a relatively low viscosity of from 50 to 1000 cSt must be used on the basis of the necessity of applying a large quantity of oil onto the fixing roll compared with the case where the oil coating roller is used for a monochrome copying machine or a monochrome printer. Further, for the same reason, the quantity of oil exuding during the stopping of the machine increases. There is still a problem that a larger quantity of silicone oil than the proper quantity is applied onto the fixing roll for a short time just after the restart of paper feeding.

Further, in the case where copying or printing is performed for sheets of plastic OHP paper, unevenness in depth of toner occurs in an fixed image easily because very slight unevenness in application of oil has a bad influence on the fixing of toner. Although the surface of a felt layer formed of a felt tape wound helically is apparently flat, there is a delicate level difference in each of abutting portions in end surfaces of the felt tape. The level difference extends helically. Accordingly, though the level difference is slight, the level difference becomes a cause of stripe-like unevenness in application of oil and becomes a cause of unevenness in depth of toner in the fixed image as well.

Besides the aforementioned oil coating roller, various oil coating rollers have been already proposed. For example, there is an oil coating roller in which a cylindrical molded product of a porous hollow metal pipe or heat-resistant fibers is used as the oil holding member for storing release oil to be applied and in which an oil coating quantity control layer of a polytetrafluorethylene (PTFE) porous film, or the like, is wound on a surface of the cylindrical molded product and RTV (room temperature vulcanization) silicone rubber is applied onto end and lap portions of the oil coating quantity control layer to adhesively bond the oil coating quantity control layer to the cylindrical molded product. There is also an oil coating roller in which the aforementioned oil coating quantity control layer is treated so as to be shaped like a tube and in which the oil coating quantity control layer is applied to cover a cylindrical oil holding member and heated so as to be shrunken (see JP-A-9-185282).

There is a further copying-machine coating mechanism in which an oil coating quantity control layer formed by crosslinking is provided on a surface of a thick porous tissue material as an oil holding member after a void tissue of porous polytetrafluorethylene is impregnated with a mixture of silicone rubber and release oil (see JP-B-6-73051). That is, the copying-machine coating mechanism is formed by: winding the oil coating quantity control layer by one turn as a roll on a surface of the thick porous tissue material; and then heating the oil coating quantity control layer at a high temperature for a long time to thereby perform crosslinking and thermally fusion-bond the oil coating quantity control layer to the surface of the thick porous tissue material. According to the copying-machine coating mechanism, silicone oil, which is release oil, can be controlled exactly and particularly silicone oil can be controlled stably in a long term even in a region in which a very small quantity of silicone oil is applied for oilless toner. Not only the roller shape but also a structure in which oil is applied onto the fixing roll by a flat-shaped pad is known as the form of the oil coating apparatus.

In the oil coating roller having the oil coating quantity control layer adhesively bonded to the cylindrical molded product, not only release oil is little put out from the adhesive portion so that unevenness occurs in the application of oil but also the adhesive area is so small that the oil coating quantity control layer is displaced or peeled because of shortage of adhesive strength. Accordingly, it is difficult to apply release oil onto the heat-fixing roll continuously stably. In the oil coating roller having the tube-like oil coating quantity control layer thermally shrunken, the thermal shrinking of the oil coating quantity control layer is apt to become so uneven that the pore size varies. Accordingly, it is difficult to apply release oil onto the heat-fixing roll continuously stably. Further, in the copying-machine coating mechanism, the oil coating quantity control layer must be heated at a high temperature for a long time so as to be thermally fusion-bonded to the thick porous tissue material. Accordingly, there is a tendency that this treatment takes too much labor. Also in the coater having the pad-like structure for applying oil to the fixing roll, the same problem as described above arises in the method for adhesively bonding the oil coating quantity control layer to the outermost surface layer of the pad-like structure. That is, also in this case, not only release oil is little put out from the adhesive portion so that unevenness occurs in the application of oil but also the adhesive area is so small that the oil coating quantity control layer is displaced or peeled because of shortage of adhesive strength. Accordingly, there arises a problem that the quantity of coating of oil becomes unstable.

SUMMARY OF THE INVENTION

In consideration of the problems described in the background art, an object of the present invention is to provide (1) an oil coating roller by which a proper quantity of oil can be applied continuously from the start of use even in the case where the oil is low-viscosity silicone oil, (2) an oil coating roller in which wasteful exudation of oil is suppressed during the stop of paper feeding so that there is no fear of excessive oil application just after the restart of paper feeding, and (3) an oil coating roller by which oil can be applied so extremely evenly that unevenness in the depth of toner does not occur in a fixed image even in the case where copying or printing is performed for OHP paper.

Another object of the present invention is to provide a method for adhesively bonding an oil coating quantity control layer toan oil holding member easily, and an oil coating apparatus using the method in which release oil can be applied onto a heat-fixing roll evenly as well as the oil coating quantity control layer is prevented from being displaced or peeled during the operation of the oil coating apparatus.

The oil coating roller according to the present invention is characterized as follows. The oil coating roller uses a porous round-rod-like molded product (inclusive of a hollow cylindrical molded product) as an oil holding member. Preferably, the porous round-rod-like molded product is made from heat-resistant fibers bound to one another by a binder and has fine communicating voids free from the binder among the fibers and evenly distributed pores with a pore size of from 0.05 to 2 mm and a total void percentage of from 30 to 90%. The porous round-rod-like molded product is impregnated with silicone oil. A heat-resistant fiber felt layer having a thickness of from 0.5 to 5 mm is provided on the outer circumference of the porous round-rod-like molded product. Preferably, an elastic body layer having communicating pores and having a thickness of from 0.3 to 3 mm and a compressive hardness of from 0.03 to 1.5 $N/cm^2$ is provided on the outer circumference of the felt layer. The outer circumference of the elastic body layer is covered with a porous film having a thickness of from 15 to 130 $\mu$m, a mean pore size of from 0.1 to 3.0 $\mu$m (preferably from 0.1 to 1.0 $\mu$m), a porosity of from 60 to 90% and an air permeability of from 3 to 2000 sec per 100 cc (preferably from 3 to 1500 sec per 100 cc) as the outermost surface layer.

With respect to the method for adhesively bonding an oil coating quantity control layer to an oil holding member easily, and the oil coating apparatus using the method, it has been found that silicone oil can be applied onto a heat-fixing roll evenly when an oil coating quantity control layer is adhesively bonded to the oil holding member by a mixture of an adhesive and silicone oil. Since the mixture is in a state in which the adhesive and silicone oil are dispersed in each other, portions in which pores of the oil coating quantity control layer are blocked by adhesion between the oil holding member and the oil coating quantity control layer on the basis of hardening of the adhesive are dispersively coexistent with portions in which the pores are not blocked by the interposition of unreacted silicone oil. Accordingly, the dispersed adhesive portions prevent the oil coating quantity control layer from being displaced or peeled, and the dispersed silicone oil portions serve as oil passages.

Furthermore, it has been found that the aforementioned effect concerning unevenness in application of oil can be obtained when a felt having a bending resistance (according to JIS L-1096) of from 30 to 90 mm (preferably from 50 to 70 mm) is used as the heat-resistant fiber felt without providing a two-layer structure of the felt.

DETAILED DESCRIPTION OF THE INVENTION

Figure 1:
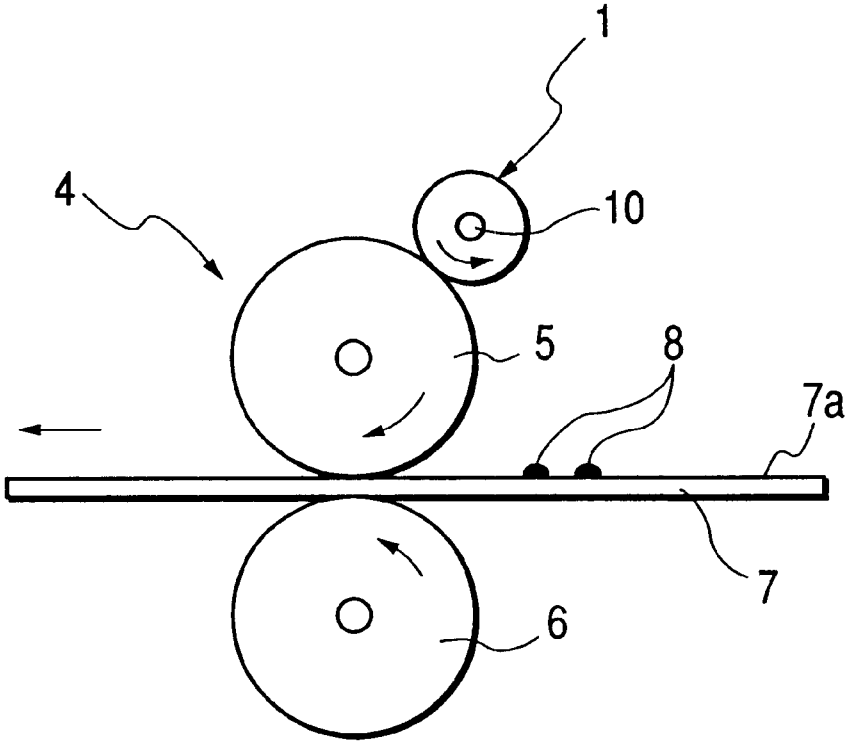
FIG. 1 is a side view showing a state in which an oil coating roller according to an embodiment of the present invention is set in a fixing apparatus.

The terminology "compressive hardness" is expressed in 25% compressive load measured by a method provided in JIS K-6767. The terminology "air permeability" is expressed in a Gurley number (unit: sec per 100 cc) measured by a B-type Curley densometer. The terminology "total void percentage" or "porosity" is expressed in a value calculated on the basis of measured values of specific gravity by the following equation.

$$\text{Total void percentage or porosity } (\%) = \{1-(\text{bulk specific gravity})/(\text{true specific gravity})\}\times 100$$

Preferably, the oil holding member provided as a core portion of the oil coating roller according to the present invention is prepared in the same manner as disclosed in JP-A-9-108601 (which corresponds to EP 0753 356A1 and U.S. Pat. No. 5,876,640) and is used to hold a large quantity of silicone oil in large-capacity pores. The silicone oil thus held migrates to the heat-resistant fiber felt layer via the fine inter-fiber voids on the basis of capillarity. In the case where the elastic body layer is provided, the silicone oil then permeates the porous film via the elastic body layer. Finally, the silicone oil exudes to the roller surface.

The porous film provided as the outermost layer stabilizes the quantity of coating of silicone oil in a very desirable level. The provision of the porous film as the surface of the oil coating roller limits the exudation of oil. Accordingly, not only the exudation of oil is suppressed for a while after the start of use and just after the restart of the operation of the oil coating roller but also the exudation of oil may be reduced during the steady-state operation of the oil coating roller. As a result, there is a prospect that a required quantity of oil cannot be applied. In use of silicone oil having a low viscosity of from 50 to 1000 cSt in combination with a polytetrafluorethylene porous film having a thickness of from 15 to 130 $\mu$m, a mean pore size of from 0.1 to 3.0 $\mu$m (preferably from 0.1 to 1.0 $\mu$m), a porosity of from 60 to 90% and an air permeability of from 3 to 2000 sec per 100 cc (preferably from 3 to 1500 sec per 100 cc), however, not only the problem in application of excessive oil at the start of use and at the restart of the operation is solved greatly but also a large quantity of oil is applied during the steady-state operation rather than the quantity of oil in the case where the porous film is not provided. As a result, vary stable oil application is achieved.

Incidentally, there is a prospect that a porous film having a pore size larger than the aforementioned pore size and, accordingly, having a porosity lower than the aforementioned porosity, is not inferior in the original function of stabilizing the quantity of coating of oil. When such a porous film is practically used for a long term, the quantity of coating of oil is reduced greatly because pores are supposed to be clogged with toner gathered from the fixing roll. Accordingly, such a porous film is undesirable.

In the case where the elastic body layer is provided between the porous film and the felt layer, the elastic body layer has a cushioning function based on its elastic deformability to thereby prevent the contact pressure between the oil coating roller and the fixing roll from varying due to the unevenness in surface of the felt layer to thereby prevent the variation of the contact pressure from causing unevenness in application of oil and unevenness in fixing of an image.

A typical method for producing the oil coating roller according to the present invention will be described below but the producing method is not limited thereto.

The oil holding member most suitable for the oil coating roller according to the present invention can be produced by a method described in JP-A-9-108601. That is, a water-resistant granular organic substance such as particulate synthetic resin, wood flour, carbon powder, or the like, to form pores, an appropriate binder and an inorganic filler, if necessary, to adjust the inter-fiber void quantity of the finished article are generally mixed with heat-resistant fiber (preferably, having a fiber diameter of from about 2 to about 15 $\mu$m) such as aluminosilicate fiber, alumina fiber, glass fiber, aramid fiber, or the like, in the following proportion while a proper quantity of water is added thereto. The mixture thus prepared is molded into a desired shape.

Heat-resistant fiber (the sum of heat-resistant fiber and the filler if the filler is used) 100 parts by weight Water-resistant granular organic substance 10 to 300 parts by weight Binder 2 to 100 parts by weight (50 to 300 parts by weight if a mixture of an organic binder and an inorganic binder is used)

The molded product thus obtained is heated so as to be dried and hardened. The molded product is further heated to a temperature of from about 150 to about 400° C. (and further sintered at a temperature of from about 400 to 1000° C. if an inorganic binder is used in combination with the organic binder) so that the granular organic substance is burned or decomposed/gasified so as to disappear. Thus, pores are left.

By the selection of raw materials and the selection of mixture proportion, molding conditions, and so on, in the aforementioned process, pores having a pore size of from 0.05 to 2 mm and inter-fiber communicating voids preferably having a void size of from 5 to 30 $\mu$m are formed in the sintered molded product so that the total void percentage is from 30 to 90% (preferably from about 70 to about 85%). The aforementioned selection is required so that oil as much as possible can be held with mechanical strength secured and that the held oil can be discharged smoothly.

The oil holding member thus obtained is immersed in silicone oil having a viscosity of from 50 to 1000 cSt so as to absorb silicone oil so that almost all the pores in the oil holding member are filled with silicone oil.

Alternatively, a porous cylindrical molded product of any fiber or metal can be used as the oil holding member.

Then, felt having a thickness of from 0.5 to 5 mm, preferably of from 1 to 3 mm and cut like a tape having a width of about 30 mm is wound helically on and fixed to the outer circumference of the oil holding member. The heat-resistant fiber felt layer may be composed of two or more layers as long as the total thickness is from 0.5 to 5 mm. A preferred material for the felt is heat-resistant synthetic fiber such as aramid fiber, or the like, having a bulk density of about 150 to about 300 kg/m$^3$. This felt layer has not only a function of sucking oil from the oil holding member but also a function of deforming itself elastically to increase the contact area between the heat roll of the fixing apparatus and the oil coating roller to thereby prevent unevenness in application of oil.

In the case where an elastic body layer is provided on the felt layer, a sheet of a porous elastic body is wound on the felt layer. Examples of a suitable material for the elastic body include nonwoven fabric, foamed polyurethane, foamed melamine resin, and so on. The used elastic body sheet is required to have a moderate thickness. If the thickness is smaller than 0.3 mm, it is often impossible to absorb the surface roughness of the felt layer thoroughly so that the effect of preventing unevenness in application of oil becomes insufficient. If the thickness is contrariwise larger than 3 mm, a required quantity of oil is hardly supplied to the outermost surface layer. The compressive hardness of the elastic body layer is important to provide an appropriate compressive elasticity. When the elastic body layer has a compressive hardness in a range of from 0.03 N/cm$^2$ to 1.5 N/cm$^2$, the elastic body layer exhibits moderate elastic deformation required for absorbing the surface roughness of the felt layer to keep the contact pressure of the oil coating roller uniform.

Finally, the aforementioned porous film is wound and fixed. The most suitable material for the porous film is polytetrafluorethylene because it is excellent in the aforementioned desired function. Polytetrafluorethylene porous films different in pore size, pore quantity, film thickness, etc. and exhibiting various kinds of characteristic are placed on the market. Accordingly, the porous film used in the present invention is available. Examples of the available porous film include POREFLON made by Sumitomo Electric Industries, Ltd., and so on.

From the above description, the oil coating roller according to the present invention is obtained. Incidentally, a shaft for attaching the oil coating roller to the fixing apparatus in a copying machine or printer can be set in any suitable stage before or after impregnation with silicone oil.

Next, an oil coating apparatus produced by a method of adhesively bonding an oil coating quantity control layer which uses a mixture of an adhesive and an oil according to the present invention will be described below.

As a first aspect thereof, there is provided an oil coating apparatus wherein an oil coating quantity control layer is adhesively bonded to an oil holding member by a mixture of an adhesive and silicone oil. By use of such a configuration, the oil holding member and the oil coating quantity control layer are adhesively bonded to each other dispersively as a whole when the dispersed adhesive is hardened, so that the dispersed silicone oil secures silicone oil passages in the oil coating quantity control layer dispersed as a whole.

As a second aspect thereof, there is provided an oil coating apparatus wherein an oil coating quantity control layer is adhesively bonded, by a mixture of an adhesive and silicone oil, to an oil migration or elastic body layer provided on the oil coating side of an oil holding member. By use of such a configuration, the same function as described above is fulfilled also in the case where the oil migration or elastic body layer is provided between the oil holding member and the oil coating quantity control layer in order to prevent unevenness in application of oil.

As a third aspect thereof, there is provided an oil coating apparatus wherein the aforementioned adhesive bonding is performed in the condition that the aforementioned mixture is interposed in the whole contact surface between the oil holding member and the oil coating quantity control layer or in the whole contact surface between the oil migration or elastic body layer and the oil coating quantity control layer. By use of such a configuration, in addition to the aforementioned function, the oil holding member or the oil migration or elastic body layer is dispersively adhesively bonded to the oil coating quantity control layer on the whole contact surface, so that the dispersed silicone oil secures silicone oil passages dispersed in the oil coating quantity control layer.

As a fourth aspect thereof, there is provided an oil coating apparatus wherein the oil coating quantity control layer has an air permeability of from 3 to 2000 sec per 100 cc, preferably from 10 to 2000 sec per 100 cc. By use of such a configuration, in addition to the aforementioned function, a proper quantity of silicone oil held by the oil holding member can permeate the oil coating quantity control layer.

As a fifth aspect thereof, there is provided an oil coating apparatus wherein the oil coating quantity control layer is constituted by a polytetrafluorethylene (PTFE) porous film. By use of such a configuration, in addition to the aforementioned function, a constant quantity of silicone oil can be applied onto the heat-fixing roll stably so that there is nodifference between the quantity of silicone oil at the start of the operation and the quantity of silicone oil during the steady-state operation.

As a sixth aspect thereof, there is provided an oil coating apparatus wherein: the adhesive is silicone varnish; and the mixture contains silicone varnish (SW) and silicone oil (SO) in the mixture proportion (SW:SO) of from 2:8 to 9:1. By use of such a configuration, in addition to the aforementioned function, a good balance state is obtained so that not only the adhesive strength between the oil holding member and the oil coating quantity control layer can be secured but also silicone oil can be applied. Accordingly, the quantity of coating of silicone oil can be controlled freely within the aforementioned mixture proportion range.

An embodiment of the present invention will be described in detail below with reference to FIGS. 1 through 5.

Figure 2:
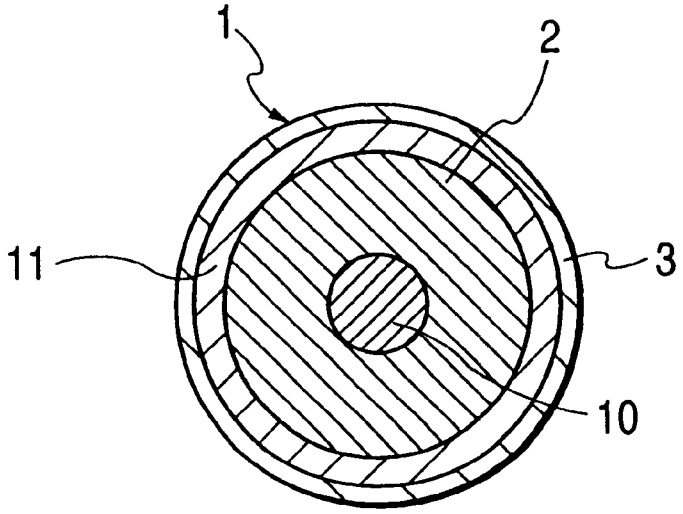
FIG. 2 is a cross sectional view of the oil coating roller according to the embodiment of the present invention.
Figure 3:
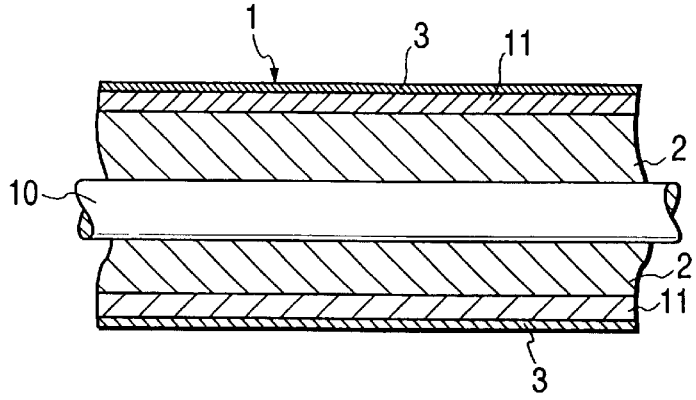
FIG. 3 is a longitudinal sectional view of the oil coating roller according to the embodiment of the present invention.

FIG. 1 is a side view of a fixing apparatus in which an oil coating roller as an embodiment of the present invention is set. FIG. 2 is a cross sectional view of the oil coating roller as the embodiment of the present invention. FIG. 3 is a longitudinal sectional view of the oil coating roller as the embodiment of the present invention. In the drawings, the reference numeral 1 designates an oil coating roller. The oil coating roller 1 has, as fundamental constituent members, an oil holding member 2, and an oil coating quantity control layer 3 adhesively bonded to the oil holding member 2 by a mixture of an adhesive and silicone oil. The oil coating roller 1 is set in a fixing apparatus 4. The fixing apparatus 4 is used to fix toner 8 transferred onto a surface 7*a* of a sheet of recording paper 7 inserted between a heat-fixing roll 5 and a pressing roll 6. The fixing apparatus 4 brings the oil coating roller 1 into contact with the heat-fixing roll 5 to apply silicone oil as releasing oil onto the heat-fixing roll 5 while preventing the toner 8 on the surface 7*a* of the sheet of recording paper 7 from depositing on the heat-fixing roll 5.

The structure of the oil holding member 2 is not limited specifically if the oil holding member 2 can hold silicone oil. In this embodiment, the oil holding member 2 is constituted by a cylindrical porous molded product which contains, as a main component, aluminosilicate fibers bound with one another by a binder and which has fine communicating pores, as portions free from the binder, among the fibers. The porosity of the oil holding member 2 is selected to be in a range of from 60 to 80%, so that the oil holding member 2 can hold a large amount of silicone oil. The oil holding member 2 is mounted on a shaft 10. An oil migration layer 11 is formed on the outer circumference of the oil holding member 2. The oil migration layer 11 is made of heat-resistant fiber felt. The oil migration layer 11, which is wound on the outer circumference of the oil holding member 2, plays the role of absorbing silicone oil from the oil holding member 2 and supplying the silicone oil to the oil coating quantity control layer 3. In this embodiment, a material having a thickness in a range of from 2 to 3 mm and a density in a range of from 170 to 260 kg/m$^3$ is used as the heat-resistant fiber felt. The heat-resistant fiber felt is, however, not limited specifically. Silicone oil having a low viscosity in a range of from 50 to 300 cSt (25° C.) is generally used as the silicone oil held by the oil holding member 2.

The oil coating quantity control layer 3 is not limited specifically if the oil coating quantity control layer 3 has an air permeability in a range of from 3 to 2000 sec per 100 cc and can transmit silicone oil. In this embodiment, a stretched polytetrafluorethylene (PTFE) porous film (hereinafter referred to as PTFE porous film) is used as the oil coating quantity control layer 3. For example, the PTFE porous film used has a surface roughness Ra in a range of from 0.7 to 0.8 $\mu$m, a thickness in a range of from 30 to 60 $\mu$m, an air permeability in a range of from 60 to 100 sec per 100 cc, a pore size in a range of from 0.05 to 0.1 $\mu$m and a porosity of 60%. When the PTFE porous film is impregnated with silicone rubber by a surface treatment, the air permeability of the PTFE porous film reaches about 1000 sec per 100 cc. Accordingly, the air permeability of the PTFE porous film can be changed easily. The "air permeability" is expressed as a Gurley number (unit: sec per 100 cc) measured by a B type Gurley densometer. The "porosity" is expressed as a value calculated on the basis of measured values of specific gravity in accordance with the equation: porosity (%)=(1−bulk specific gravity/true specific gravity)×100.

The oil coating quantity control layer 3 is adhesively bonded, by a mixture of an adhesive and silicone oil, to the oil migration layer 11 formed on the outer circumference of the oil holding member 2. It is important for the mixture that the adhesive and the silicone oil are mixed with and dispersed in each other sufficiently. After the mixture is applied onto the whole outer circumferential surface of the oil migration layer 11, the oil coating quantity control layer 3 is wound by one turn on the surface coated with the mixture so that the oil coating quantity control layer 3 is adhesively bonded to the oil migration layer 11. That is, the whole surface of the oil coating quantity control layer 3 in contact with the whole outer circumferential surface of the oil migration layer 11 is adhesively bonded to the whole outer circumferential surface of the oil migration layer 11 by the mixture. The adhesive is not limited specifically if the oil migration layer 11 and the oil coating quantity control layer 3 can be adhesively bonded to each other by the adhesive coexistent with silicone oil. In this embodiment, silicone varnish is employed as the adhesive and the mixture ratio of silicone varnish (SW) to silicone oil (SO) is in a range of from 2:8 to 9:1. If the mixture ratio is higher than 9:1 (e.g. 9.5:0.5), the quantity of coating becomes insufficient because there are too many adhesive portions for few silicone oil paths. If the mixture ratio is contrariwise lower than 2:8 (e.g. 1:9), the strength of adhesion between the oil migration layer 11 and the oil coating quantity control layer 3 becomes insufficient because there are too few adhesive portions.

An adhesive generally called silicone varnish can be used as the aforementioned silicone varnish. That is, silicone resin is a kind of silicone rubber having its crosslink density increased extremely, and silicone varnish is formed from unreacted silicone resin dissolved in a solvent. The silicone varnish contains a large number of tri- or tetra-functional components and is more excellent in adhesive power than silicone rubber. Specific examples of the silicone oil mixed with the silicone varnish include straight-chain methyl silicone oil, branched-chain methyl silicone oil, methylphenyl silicone oil, and modified silicone oil with some dimethyl groups replaced by other organic groups. The viscosity of the silicone oil is generally in a range of from 100 to 500,000 cSt at 25° C., preferably from 100 to 100,000 cSt at 25° C., more preferably from 5,000 to 30,000 cSt at 25° C.

Figure 4:
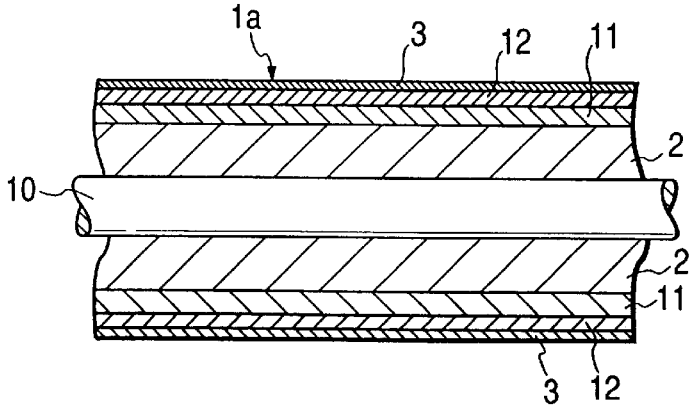
FIG. 4 is a longitudinal sectional view of the oil coating roller according to another embodiment of the present invention.

FIG. 4 shows another embodiment of the present invention. The point of difference of the oil coating roller 1*a* in FIG. 4 from the oil coating roller in FIGS. 1 through 3 is that an elastic body layer 12 is interposed between the oil migration layer 11 and the oil coating quantity control layer 3. The elastic body layer 12 is made of nonwoven fabric having a thickness of about 0.5 mm and a density of about 60 kg/m$^3$. The elastic body layer 12 is used to eliminate the level difference which is generated when the heat-resistant fiber felt of the oil migration layer 11 is wound on the outer circumference of the oil holding member 2. Although the level difference is negligible when toner is fixed onto a sheet of ordinary recording paper, unevenness in depth of toner may occur in a fixed image because of the uneven application of silicone oil caused by the level difference when toner is fixed onto a sheet of plastic OHP paper. Accordingly, because the elastic body layer 12 is interposed between the oil migration layer 11 and the oil coating quantity control layer 3, the oil coating roller 1*a* is useful for eliminating the level difference to prevent the uneven application of silicone oil to thereby prevent unevenness in depth of toner from occurring in a fixed image.

Figure 5:
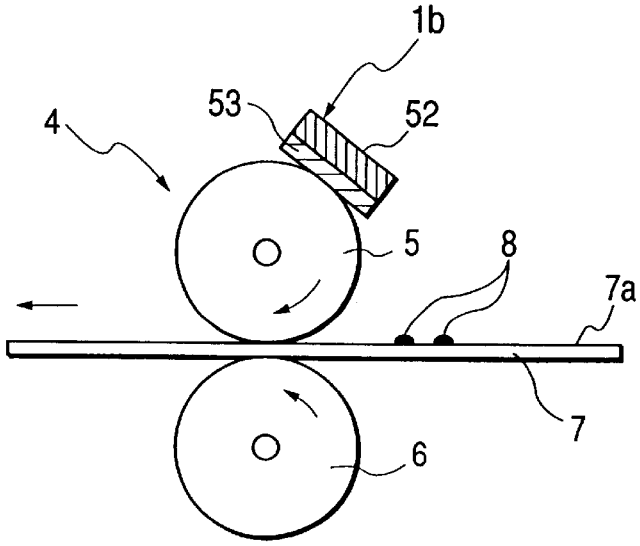
FIG. 5 is a side view showing a state in which an oil coating apparatus according to a further embodiment of the present invention is set in a fixing apparatus.

FIG. 5 shows a further embodiment of the present invention. FIG. 5 shows an example in which a flat-plate-like pad is employed as the structure of an oil coating apparatus for applying release oil onto the heat-fixing roll 5. In this structure, a PTFE porous film 53 is adhesively bonded, by a mixture of an adhesive and silicone oil, to a surface of a flat-plate-like oil holding portion 52 of a porous material or a material such as felt. In this case, an oil coating pad 1*b* is brought into contact with the heat-fixing roll 5 in the condition that the oil coating pad 1*b* is fixed.

Furthermore, the above-mentioned effect concerning unevenness in application of oil can be also obtained when a felt having a bending resistance (according to JIS L-1096) of from 50 to 70mm is used as the heat-resistant fiber felt without providing a two-layer structure of the felt. In this embodiment, it is preferred that the felt is wound as a roll of two or more layers in a total thickness of 5 mm or less.

The present invention will be further described in the following examples, but the present invention should not be construed as being limited thereto.

EXAMPLES

Comparative Example 1 (Comp.Ex.1)

A cylindrical porous molded product (having fine inter-fiber voids and pores with a pore size in a range of from about 0.1 to about 0.3 mm and with a total void percentage of 78%) containing aluminosilicate fibers with a mean fiber size of 3.8 $\mu$m as a main component and having an outer diameter of 22 mm, an inner diameter of 6 mm and a length of 300 mm was impregnated with about 73 g of silicone oil having a viscosity of 100 cSt. Then, a shaft was inserted in a hollow portion of the cylindrical porous molded product. The cylindrical porous molded product was fixed at opposite ends of the shaft. Then, aramid heat-resistant fiber felt (with a bulk density of 260 kg/m$^3$ and a thickness of 2 mm) was wound on and fixed to the outer circumferential surface of the cylindrical porous molded product to thereby obtain an oil coating roller for a fixing apparatus in a color copying machine.

Comparative Example 2 (Comp.Ex.2)

Heat-resistant paper (made of a mixture of aramid fiber and polyester fiber and having a thickness of 55 $\mu$m, a mean pore size of 30 $\mu$m and an air permeability of 2 sec per 100 cc) was wound on and fixed to the outer circumferential surface of the oil coating roller obtained in Comparative Example 1.

Examples 1 and 2 (Ex.1 and Ex.2)

A polytetrafluorethylene porous film as shown in Table 1 was wound on and fixed to the outer circumferential surface of the oil coating roller obtained in Comparative Example 1.

Test 1

The aptitude of the oil coating roller obtained in each of Examples 1 and 2 and Comparative Examples 1 and 2 as a silicone oil coating roller for a fixing apparatus in a color copying machine was examined by the following testing method.

Testing Method: The change of the oil coating quantity (mg per sheet) was examined when sheets of paper were fed continuously at a paper feed speed of 16 sheets per minute in the condition that the coating roller was attached to an oil discharge characteristic testing machine.

Testing results were as shown in Table 1. It was apparent that coating the surface with the specific porous film gave a solution to the problem of initial surplus coating and suppressed the reduction of the coating quantity.

TABLE 1

| | | Comp. Ex. 1 | Comp. Ex. 2 | Ex. 1 | Ex. 2 |
|---|---|---|---|---|---|
| Felt Layer Coating Layer | Material | None | heat-resistant paper | PTFE | PTFE |
| | Mean Pore Size ($\mu$m) | | 30 | 0.1 | 0.5 |
| | Porosity (%) | | | 68 | 78 |
| | Thickness ($\mu$m) | | 55 | 70 | 85 |
| | Air Permeability (sec per 100 cc) | | 2 | 35 | 9 |
| Oil Coating Quantity (mg per sheet) | after 500 sheets (A) | 5.62 | 7.50 | 3.48 | 3.88 |
| | after 1000 sheets | 2.63 | 4.34 | 2.48 | 2.82 |
| | after 2000 sheets | 1.70 | 3.66 | 2.10 | 2.45 |
| | after 3000 sheets | 1.51 | 3.15 | 2.05 | 2.40 |
| | after 4000 sheets | 1.36 | 3.00 | 2.03 | 2.38 |
| | after 5000 sheets | 1.17 | 2.72 | 2.00 | 2.34 |
| | average (B) after stabilization | 1.35 | 2.96 | 2.03 | 2.37 |
| | Stability (A/B) | 4.16 | 2.53 | 1.71 | 1.64 |

Note 1 "PTFE" was a polytetrafluorethylene porous film.
Note 2 "Average after stabilization" was an average of from the value after 3000 sheets to the value after 5000 sheets.

Test 2

The stability of the oil coating quantity was examined in the condition that the oil coating roller obtained in each of Example 1 and Comparative Example 2 was attached to a middle-speed copying machine. This test was performed as follows. After 2000 sheets of paper were fed at a paper feed speed of 65 ppm, paper feeding was interrupted. After 3 hours, paper feeding was re-started. The oil coating quantity before the interruption of paper feeding was compared with the oil coating quantity after the interruption of paper feeding.

Testing results were as shown in Table 2. It was apparent that the oil coating roller obtained in Example 1 (Ex.1) did not apply any surplus of oil even just after re-starting of paper feeding.

TABLE 2

| | Ex. 1 | Comp. Ex. 1 |
|---|---|---|
| Oil Coating Quantity (mg per sheet) at feeding of 2000 sheets of paper | 2.20 | 2.66 |
| Oil Coating Quantity (mg per sheet) just after re-starting of paper feeding | 2.52 | 4.42 |

Examples 3 to 6 (Ex.3 to Ex.6) and Reference Examples 1 to 3 (Ref.Ex.1 to Ref.Ex.3)

A cylindrical porous molded product (with an outer diameter of 29 mm, an inner diameter of 8 mm and a length of 338 mm) produced in the same manner as in Comparative Example 1 was impregnated with about 120 g of silicone oil having a viscosity of 100 cSt. Then, a shaft was inserted in a hollow portion of the cylindrical porous molded product. The cylindrical porous molded product was fixed at opposite ends of the shaft. Then, aramid fiber felt (with a bulk density of 260 kg/m$^3$ and a thickness of 2 mm) cut like a 30 mm-wide tape was wound helically on and fixed to the outer circumferential surface of the cylindrical porous molded product. Polyester fiber nonwoven fabric was further wound on the felt to thereby form an elastic body layer. A polytetrafluorethylene porous film (with a mean pore size of 0.1 $\mu$m, a porosity of 60% and a thickness of 30 $\mu$m) was further wound on and fixed to the elastic body layer.

While the nonwoven fabric, which was a material for the elastic body layer, was changed variously, examples of the oil coating roller were produced by the aforementioned method. The examples of the oil coating roller were compared in performance by the following testing method. Further, an oil coating roller produced in the aforementioned manner without provision of any elastic body layer was examined as a reference example.

Testing Method: In the condition that the oil coating roller was attached to a fixing apparatus in a color copying machine, magenta single-color toner was fixed onto the whole surfaces of sheets of A4-size OHP paper at a paper feed speed of 4 sheets per minute. Unevenness in the depth of the magenta color due to the toner fixed on the whole surfaces was observed with the naked eye so that the quality of image was evaluated on the basis of the following criterion.

A: The image quality was very good.

B: The image quality was good.

C: Unevenness in depth of color was partially observed in accordance with winding marks of the felt.

D: Unevenness in depth of color was intensive.

Testing results were as shown in Table 3.

TABLE 3

| | Presence or Absence of Elastic Body Layer | Thickness of Elastic Body Layer | Compressive Hardness of Elastic Body | Evaluation of Fixed Image |
|---|---|---|---|---|
| Ex. 3 | presence | 1.0 mm | 0.9 N/cm$^2$ | A |
| Ex. 4 | presence | 0.5 mm | 0.9 N/cm$^2$ | B |
| Ex. 5 | presence | 1.5 mm | 0.9 N/cm$^2$ | A |
| Ex. 6 | presence | 1.0 mm | 1.4 N/cm$^2$ | B |
| Ref. Ex. 1 | absence | — | — | D |
| Ref. Ex. 2 | presence | 0.1 mm | 0.5 N/cm$^2$ | C |
| Ref. Ex. 3 | presence | 1.0 mm | 1.8 N/cm$^2$ | C |

The present invention will be described more specifically by way of example.

Example 7 (Ex.7)

An oil holding member having an outer diameter of 29.4 mm, an inner diameter of 8.0 mm and a length of 338.0 mm was produced from aluminosilicate fiber as a main component. A shaft was inserted in the oil holding member. Further, the oil holding member was impregnated with about 130 g of dimethyl silicone oil having a viscosity of 100 cSt (25° C.). Aramid heat-resistant fiber felt (trade name "NOMEX": made by Japan Felt Ind. Co., Ltd.) having a thickness of 2.8 mm and a density of 260 kg/m$^3$ was wound on and fixed to the outer circumferential surface of the oil holding member to thereby form an oil migration layer. Further, a 9:1 mixture solution of silicone varnish ("KR105" made by Shin-Etsu Chemical Co., Ltd.) and silicone oil ("KF-96" made by Shin-Etsu Chemical Co., Ltd.) (with about 3% by weight of a curing accelerator added to the mixture solution) was applied onto the whole surface of an oil coating quantity control layer which was a stretched PTFE porous film with the largest pore size of 0.1 $\mu$m. The oil coating quantity control layer was wound and bonded, by one turn, as a roll on the outer circumferential surface of the oil migration layer. Thus, an oil coating roller was obtained. The oil coating roller was evaluated by the following examinations (1) and (2).

(1) The oil coating roller was attached to an available color printer (color paper feed speed: 4 ppm). 5000 sheets of ordinary color paper were fed to the printer. The quantities of silicone oil applied onto a sheet of ordinary color paper were measured after paper feeding of 500 sheets, 1000 sheets, 2000 sheets, 3000 sheets, 4000 sheets and 5000 sheets respectively. Further, peeling or displacement of the oil coating quantity control layer after printing of a volume comparable to 30,000 sheets having a A4 size was examined by eye observation. If no peeling or displacement is observed, it is rated as "A", and if peeling or displacement is observed, it is rated as "B".

(2) In the aforementioned color printer, a solid-print image of a magenta single color was fixed onto five sheets of OHP paper. The sheet of OHP paper was then fed out. Uneven application of silicone oil on the five sheets of OHP paper was observed. The uneven application of silicone oil was observed as unevenness in density or depth of color on the solid-print image of the magenta single color. If no unevenness is observed, it is rated as "A" and if unevenness is observed, it is rated as "B".

Examples 8 to 10 (Ex.8 to Ex.10)

Examples of the oil coating roller were obtained in the same manner as in Example 7 except that the mixture ratio of silicone varnish to silicone oil in Example 7 was changed within the range of the present invention shown in Table 1. Those examples of the oil coating roller were evaluated by the examinations (1) and (2). Results were as shown in Table 4.

Comparative Examples 3 and 4 (Comp.Ex.3 and Comp.Ex.4)

Examples of the oil coating roller were obtained in the same manner as in Example 7 except that the mixture ratio of silicone varnish to silicone oil in Example 7 was changed as shown in Table 1. Those examples of the oil coating roller were evaluated by the examinations (1) and (2). Results were as shown in Table 4.

TABLE 4

| | Examples according to the present invention | | | | Comparative Examples | |
|---|---|---|---|---|---|---|
| | Ex. 7 | Ex. 8 | EX. 9 | Ex. 10 | Comp. Ex. 3 | Comp. Ex. 4 |
| varnish/oil | 9/1 | 8/2 | 5/5 | 2/8 | 10/0 | 1/9 |
| oil coating quantity (mg/A4) | | | | | | |
| after 500 sheets | 0.50 | 0.70 | 1.20 | 2.20 | no oil supply | 2.70 |
| after 1000 sheets | 0.40 | 0.55 | 0.95 | 1.65 | no oil supply | 2.10 |
| after 2000 sheets | 0.30 | 0.50 | 0.80 | 1.30 | no oil supply | 1.60 |
| after 3000 sheets | 0.30 | 0.45 | 0.75 | 1.25 | no oil supply | 1.45 |
| after 4000 sheets | 0.25 | 0.45 | 0.75 | 1.20 | no oil supply | 1.40 |
| after 5000 sheets | 0.25 | 0.45 | 0.75 | 1.20 | no oil supply | 1.35 |
| peeling or displacement after test | A | A | A | A | — | B |
| uneven application of oil onto OHP paper | A | A | A | A | — | A |

According to Table 4, the quantity of coating of silicone oil in the examination (1) for Examples 7 to 10 increased gradually as the mixture ratio of silicone varnish as an adhesive to silicone oil in the mixture of silicone varnish and silicone oil decreased. On the contrary, in Comparative Example 3, the quantity of coating of silicone oil was zero because adhesive bonding was performed for the whole surface only by silicone varnish. In Comparative Example 4, the quantity of coating of silicone oil was the largest because the mixture ratio of silicone varnish to silicone oil was the lowest. In the examination (1) for Examples 7 to 10, there was no peeling or displacement in the oil coating quantity control layer. On the contrary, in the examination (1) for Comparative Example 4, displacement occurred in the oil coating quantity control layer because the mixture ratio of silicone varnish to silicone oil was so low that the adhesively bonding force was weak. Incidentally, in Comparative Example 3, peeling or displacement in the oil coating quantity control layer was not checked because the quantity of coating silicone oil was zero. It was confirmed from the results of Examples 7 to 10 and Comparative Examples 3 and 4 that the quantity of coating of silicone oil could be controlled by change of the mixture ratio of silicone varnish to silicone oil in the mixture of silicone varnish as an adhesive and silicone oil and that the range of the mixture ratio of silicone varnish (SW) to silicone oil (SO) capable of controlling the quantity of coating of silicone oil was from 2:8 to 9:1 (the range of SW:SO was from 2:8 to 9:1).

In the examination (2) for Examples 7 to 10 and Comparative Example 4, there was no uneven application of silicone oil on OHP paper, that is, there was no difference observed. Incidentally, the examination (2) was not performed for Comparative Example 3 for the aforementioned reason.

According to the first aspect, the oil holding member and the oil coating quantity control layer are adhesively bonded to each other dispersively as a whole by hardening of a dispersed adhesive, so that passages for silicone oil are secured because dispersed silicone oil keeps the oil coating quantity control layer dispersive as a whole. Accordingly, silicone oil, which is release oil, can be applied onto the fixing roll evenly. There is an effect that the oil coating quantity control layer is prevented from being displaced or peeled during the operation of the oil coating roller. There is another effect that it is easy to adhesively bond the oil coating quantity control layer to the oil holding member.

According to the second aspect, both an oil migration layer and an elastic body layer are additionally provided between the oil holding member and the oil coating quantity control layer. Accordingly, like the first aspect of the present invention, not only the oil coating quantity control layer can be prevented from being displaced or peeled during the operation of the oil coating roller but also unevenness in application of oil can be prevented more securely.

According to the third aspect, the oil holding member and the oil coating quantity control layer are adhesively bonded to each other dispersively in terms of the whole contact surface, so that passages for silicone oil are secured so as to be dispersed in the oil coating quantity control layer because of dispersed silicone oil. Accordingly, the aforementioned effect becomes more remarkable.

According to the fourth aspect, a proper quantity of silicone oil held by the oil holding member, as well as dispersed silicone oil, can pass through the oil coating quantity control layer. In addition to the aforementioned effect, both application of a proper quantity of silicone oil and controlling of the quantity of coating of silicone oil are secured and made possible.

According to the fifth aspect, a predetermined quantity of silicone oil can be applied onto the fixing roll stably with no difference between the quantity at the time of starting of the operation of the oil coating roller and the quantity during the steady operation of the oil coating roller. Accordingly, in addition to the aforementioned effect, not only silicone oil can be applied onto the fixing roll evenly but also change of the quantity of coating of silicone oil in accordance with the operating state and the number of sheets of recording paper fed to the fixing apparatus can be reduced.

According to the sixth aspect, a good balance state is obtained so that the adhesive bonding strength between the oil holding member and the oil coating quantity control layer can be secured and silicone oil can be applied. Accordingly, the quantity of coating of silicone oil can be controlled freely in the condition that the mixture ratio of silicone varnish to silicone oil is in a predetermined range. Accordingly, both a required adhesive bonding strength and a required quantity of coating of silicone oil can be selected in accordance with purpose so that the range of use of the present invention can be widened.

Next, an example in which a felt having a bending resistance (according to JIS L-1096) of from 50 to 70 mm is used as the heat-resistant fiber felt, Example 11 is provided below, along with Examples 12 and 13 as reference examples.

Example 11 (Ex.11)

A cylindrical porous molded product having an outer diameter of 28.4 mm, an inner diameter of 8 mm and a length of 338 mm, an average pore size of 400 $\mu$m, and a total void percentage of 72% was impregnated with about 120 g of dimethyl silicone oil having a viscosity of 100 cSt. A shaft was then inserted in a hollow portion of the cylindrical porous molded product. The cylindrical porous molded product was fixed at opposite ends of the shaft. Then, aramid heat-resistant fiber felt (trade name: NOMEX, thickness: 0.7 mm, basis weight: 130 g/m$^2$, bending resistance: 60 mm) was wound and fixed by 4 turns as a roll on the cylindrical porous molded product. A stretched porous polytetrafluorethylene film (poresize: 0.1 $\mu$m, thickness: 50 $\mu$m, air permeability: 50 sec. per 100 cc) was further wound on and fixed to the outer circumference of the felt. Thus, an oil coating roller A was obtained.

Example 12 (Ex.12)

The same cylindrical porous molded product as used in Example 11 was impregnated with about 120 g of dimethyl silicone oil having a viscosity of 100 cSt. A shaft was then inserted in a hollow portion of the cylindrical porous molded product. The cylindrical porous molded product was fixed at opposite ends of the shaft. Then, a 30 mm-wide strip of aramid heat-resistant fiber felt (trade name: NOMEX, thickness: 2.0 mm, basis weight: 525 g/m$^2$, bending resistance: 96 mm) was wound helically on and fixed to the cylindrical porous molded product. Elastic felt (thickness: 0.7 mm, basis weight: 130 g/m$^2$, bending resistance: 60 mm) was further wound and fixed by one turn as a roll on the outer circumference of the strip of felt. A stretched porous polytetrafluorethylene film (pore size: 0.1 $\mu$m, thickness: 50 $\mu$m) was further wound on and fixed to the outer circumference of the elastic felt. Thus, an oil coating roller B was obtained.

Example 13 (Ex.13)

The same cylindrical porous molded product as used in Example 11 was impregnated with about 120 g of dimethyl silicone oil having a viscosity of 100 cSt. A shaft was then inserted in a hollow portion of the cylindrical porous molded product. The cylindrical porous molded product was fixed at opposite ends of the shaft. Then, a 30 mm-wide strip of aramid heat-resistant fiber felt (trade name: NOMEX, thickness: 2.8 mm, basis weight: 730 g/m$^2$, bending resistance: 126 mm) was wound helically on and fixed to the cylindrical porous molded product. A stretched porous polytetrafluorethylene film (poresize: 0.1 $\mu$m, thickness: 50 $\mu$m) was further wound on and fixed to the outer circumference of the strip of felt. Thus, an oil coating roller C was obtained.

Test 3

Each of the oil coating rollers A, B and C was attached to a fixing apparatus in a color laser printer. Toner of a magenta single color was fixed onto the whole surface of a sheet of A4-size OHP paper. The sheet of OHP paper thus obtained was examined by eye observation to evaluate unevenness in application of oil. Evaluation results were as shown in Table 5.

TABLE 5

| | Thickness of one-layer felt | Bending resistance of one-layer felt | Thickness of two-layer felt | Bending resistance of two-layer felt | Presence or absence of uneven application |
|---|---|---|---|---|---|
| Ex. 11 | 0.7 mm | 60 mm | — | — | absence |
| Ex. 12 | 2.0 mm | 96 mm | 0.7 mm | 60 mm | absence |
| Ex. 13 | 2.8 mm | 126 mm | — | — | presence |

It can be seen from the above results that in Example 11, unevenness in application of oil can be improved by a simple structure compared with Example 12.

While the invention has been described in detail and with reference to specific embodiments thereof, it will be apparent to one skilled in the art that various changes and modifications can be made therein without departing from the spirit and scope thereof.

What is claimed is:

1. An oil coating apparatus comprising:

an oil holding member; and an oil coating quantity control layer adhesively bonded to said oil holding member by an adhesive, said adhesive being included in a mixture which also includes silicone oil, wherein said oil in said mixture serves as an oil passage for said oil coating quantity control layer and wherein said mixture is interposed between contact surfaces of said oil holding member and said oil coating quantity control layer.

2. The oil coating apparatus of claim 1, wherein said oil coating quantity control layer has an air permeability in a range of from 3 to 2000 sec per 100 cc.

3. The oil coating apparatus of claim 1, wherein said oil coating quantity control layer is comprised of a polytetrafluorethylene porous film.

4. The oil coating apparatus of claim 1, wherein said adhesive is comprised of silicone varnish and wherein said mixture contains silicone varnish (SW) and silicone oil (SO) in the mixture ratio in a range of from 2:8 to 9:1.

5. An oil coating apparatus comprising:

an oil holding member;

an oil migration or elastic body layer provided on an oil coating side of said oil holding member; and an oil coating quantity control layer adhesively bonded to said oil migration or elastic body layer by an adhesive, said adhesive being included in a mixture which also includes silicone oil, wherein said oil in said mixture serves as an oil passage for said oil coating quantity control layer and wherein said mixture is interposed between contact surfaces of said oil migration or elastic body layer and said oil coating quantity control layer.

6. The oil coating apparatus of claim 5, wherein said oil coating quantity control layer has an air permeability in a range of from 3 to 2000 sec per 100 cc.

7. The oil coating apparatus of claim 5, wherein said oil coating quantity control layer is comprised of a polytetrafluorethylene porous film.

8. The oil coating apparatus of claim 5, wherein said adhesive is comprised of silicone varnish and wherein said mixture contains silicone varnish (SW) and silicone oil (SO) in the mixture ratio in a range of from 2:8 to 9:1.

* * * * *